US011737491B2

(12) United States Patent
Motodamari

(10) Patent No.: US 11,737,491 B2
(45) Date of Patent: Aug. 29, 2023

(54) FILTERED SMOKING ARTICLE

(71) Applicant: JAPAN TOBACCO INC., Tokyo (JP)

(72) Inventor: Tetsuya Motodamari, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 337 days.

(21) Appl. No.: 16/838,444

(22) Filed: Apr. 2, 2020

(65) Prior Publication Data

US 2020/0229490 A1 Jul. 23, 2020

Related U.S. Application Data

(63) Continuation of application No. PCT/JP2017/036042, filed on Oct. 3, 2017.

(51) Int. Cl.

| | |
|---|---|
| ***A24D 3/04*** | (2006.01) |
| ***A24D 1/02*** | (2006.01) |
| ***A24D 3/06*** | (2006.01) |

(52) U.S. Cl.

CPC ..... *A24D 3/04* (2013.01); *A24D 1/02* (2013.01); *A24D 3/061* (2013.01); *A24D 3/062* (2013.01)

(58) Field of Classification Search

CPC ..... A24D 3/048; A24D 3/061; A24D 3/04; A24D 1/02; A24D 1/002; A24D 1/025; A24D 1/04; A24D 1/12; A24D 3/0225; A24D 3/062; A24D 3/10; A24D 3/14; A24D 3/17

See application file for complete search history.

(56) References Cited

U.S. PATENT DOCUMENTS

| | | | | |
|---|---|---|---|---|
| 2002/0153017 | A1 | 10/2002 | Georgitsis et al. | |
| 2003/0098033 | A1 | 5/2003 | Macadam et al. | |
| 2007/0051383 | A1* | 3/2007 | Woods ..... | A24B 15/283 131/365 |

(Continued)

FOREIGN PATENT DOCUMENTS

| | | | |
|---|---|---|---|
| CN | 1382401 | A | 12/2002 |
| CN | 103917116 | A | 7/2014 |

(Continued)

OTHER PUBLICATIONS

Ono, WO-2013021863-A1 "Cigarette", Feb. 2013, Machine translation relied upon (Year: 2013).*

(Continued)

*Primary Examiner* — Kelly M Gambetta
*Assistant Examiner* — Stephanie Lynn Moore
(74) *Attorney, Agent, or Firm* — Birch, Stewart, Kolasch & Birch, LLP

(57) ABSTRACT

A filtered smoking article includes a smoking body, a filter including a filter member and an air-permeable paper, and having a flavor capsule arranged therein, and a tipping paper. The flavor capsule includes a capsule body, and a colored content liquid containing a flavor component. The air-permeable paper is arranged to be opposed to a region in which the colored content liquid is released when the flavor capsule is crushed, and has an air permeability of 1,000 C.U. to 30,000 C.U. The tipping paper is impermeable to the colored content liquid, and includes at least three transparent parts. Each of the transparent parts is arranged to be opposed to the region in which the colored content liquid is released.

18 Claims, 8 Drawing Sheets

(56) References Cited

U.S. PATENT DOCUMENTS

| | | | | |
|---|---|---|---|---|
| 2013/0081644 | A1* | 4/2013 | Noda | A24D 3/04 131/337 |
| 2014/0182614 | A1 | 7/2014 | Nicholls et al. | |
| 2014/0290678 | A1 | 10/2014 | Besso et al. | |
| 2014/0311508 | A1 | 10/2014 | Besso et al. | |
| 2014/0366901 | A1* | 12/2014 | Shinozaki | A24C 5/46 131/335 |
| 2019/0000134 | A1* | 1/2019 | Lavanant | A24D 3/061 |

FOREIGN PATENT DOCUMENTS

| | | | |
|---|---|---|---|
| CN | 103929987 | A | 7/2014 |
| CN | 104379006 | A | 2/2015 |
| EP | 1252832 | A2 | 10/2002 |
| EP | 2740370 | A1 | 6/2014 |
| EP | 2835061 | A1 | 2/2015 |
| JP | 7-250665 | A | 10/1995 |
| JP | 2014-516522 | A | 7/2014 |
| JP | 2014-532433 | A | 12/2014 |
| JP | 2014-534818 | A | 12/2014 |
| KR | 10-1589390 | B1 | 1/2016 |
| WO | WO 2013/021883 | A1 | 2/2013 |
| WO | WO 2013/068081 | A1 | 5/2013 |
| WO | WO-2017009298 | A1 * | 1/2017 ..... A24D 1/042 |

OTHER PUBLICATIONS

Extended European Search Report for European Application No. 17927883.3, dated Apr. 12, 2021.

International Search Report, issued in PCT/JP2017/036042, PCT/ISA/210, dated Jan. 9, 2018.

Chinese Office Action and Search Report for Chinese Application No. 201780095628.6, dated Jul. 2, 2021, with English translation.

Korean Office Action for corresponding Korean Application No. 10-2020-7009297, dated Nov. 30, 2021, with English translation.

Canadian Office Action, dated Apr. 27, 2021, for Canadian Application No. 3,077,507.

Japanese Office Action for Japanese Application No. 2021-047739, dated Jun. 28, 2022, with English translation.

"Printing Paper: Printability and Printing Features," Light Industry Press, Dec. 31, 1986, pp. 137-139 (10 pages total), with English translation.

Chinese Office Action and Search Report for corresponding Chinese Application No. 201780095628.6, dated Feb. 7, 2022, with English translation.

* cited by examiner

FILTERED SMOKING ARTICLE

CROSS-REFERENCE TO RELATED APPLICATIONS

This application is a Continuation Application of PCT Application No. PCT/JP2017/036042 filed Oct. 3, 2017, the entire contents of which are incorporated herein by reference.

BACKGROUND OF THE INVENTION

1. Field of the Invention

The present invention relates generally to a filtered smoking article.

2. Description of the Related Art

A filtered smoking article, for example, a filtered cigarette is a product in which a cigarette rod and a filter are made to abut on each other and an outer peripheral surface of a downstream end part of the cigarette rod and an outer peripheral surface of the filter are integrally wound with tipping paper. Since the tipping paper usually has a role of concealing the seam between the filter and the cigarette rod and also concealing a color of tar adhering to the filter by smoking, an opaque paper is used as the tipping paper.

In recent years, filtered smoking articles having a structure in which a flavor capsule is arranged inside the filter are known. In the filtered smoking article, a smoker can crush the flavor capsule at the time of use, enjoy the flavor of a content liquid of the flavor capsule, and mask the odor of cigarette butt (Patent Literature 1: JP H07-250665 A). However, the filtered smoking article having a flavor capsule arranged inside the filter has a problem that when opaque tipping paper is used, the smoker can hardly recognize visually whether the content liquid of the flavor capsule is sufficiently released into the filter, after crushing the flavor capsule. For this reason, in order to visually recognize that the content liquid of the flavor capsule is sufficiently released into the filter, a filtered smoking article in which the content liquid of the flavor capsule contains a colorant and a window for visualizing the filter is provided on a part of an opaque tipping paper has been considered.

BRIEF SUMMARY OF THE INVENTION

In such a filtered smoking article, however, generally, even if the content liquid is sufficiently released in the filter after crushing the flavor capsule, the released content liquid permeates into an only limited position on the outer peripheral surface of the filter. More specifically, when an outer peripheral surface of a filter FL in which a flavor capsule CP is arranged is sandwiched between an index finger F1 and a thumb F2 and pressed with a force P to crush the flavor capsule CP as shown in (a) of FIG. 1, the content liquid often penetrates locally only into a part (region S) of the outer peripheral surface of the pressed filter FL as shown in (b) of FIG. 1. For this reason, even if a window is provided at a part of the tipping paper, the smoker often cannot visually recognize that the content liquid of the flavor capsule is sufficiently released when the position of the window does not coincide with the position of the part (region S) of the outer peripheral surface of the filter where the content liquid has permeated locally.

The present invention aims to solve the above-mentioned problems, and provide a filtered smoking article having a flavor capsule arranged inside the filter, which allows the smoker to visually recognize that the colored content liquid of the flavor capsule is sufficiently released after crushing the flavor capsule.

According to one embodiment of the present invention, there is provided a filtered smoking article comprising: a smoking body; a filter comprising a filter member arranged at a downstream end of the smoking body and an air-permeable paper provided to be wound around an outside of the filter member, and further having a flavor capsule arranged therein; and a tipping paper wound around an outer peripheral surface of a downstream end part of the smoking body and an outer peripheral surface of the filter, and connecting the smoking body and the filter, wherein the flavor capsule comprises a capsule body, and a colored content liquid stored in the capsule body and containing a flavor component, the air-permeable paper is arranged to be opposed to a region in which the colored content liquid is released when the flavor capsule is crushed, and has an air permeability of 1,000 C.U. to 30,000 C.U., and the tipping paper is impermeable to the colored content liquid, and comprises at least three transparent parts that are arranged to be spaced apart from each other in the circumferential direction of the tipping paper and, and each of the transparent parts is arranged to be opposed to the region in which the colored content liquid is released.

Examples of the smoking articles include cigarettes, cigars, carbon heat source-heated smoking articles, electrically heated non-burning smoking articles, and the like.

According to the other embodiment of the present invention, there is provided a filtered smoking article, comprising: a smoking body; a filter comprising a filter member arranged at a downstream end of the smoking body, an air-permeable paper provided to be wound around an outside of the filter member, and a transparent plug wrapper provided to be wound around an outside of the air-permeable paper, and further having a flavor capsule arranged therein; and a tipping paper wound around an outer peripheral surface of a downstream end part of the smoking body and an outer peripheral surface of the filter, and connecting the smoking body and the filter, wherein the flavor capsule comprises a capsule body, and a colored content liquid stored in the capsule body and containing a flavor component, the air-permeable paper is arranged to be opposed to a region in which the colored content liquid is released when the flavor capsule is crushed, and has an air permeability of 1,000 C.U. to 30,000 C.U., the transparent plug wrapper is impermeable to the colored content liquid and has a transparent part at least in part, and the tipping paper comprises at least three opening parts that are arranged to be spaced apart from each other in the circumferential direction of the tipping paper, and each of the opening parts is arranged to be opposed to the region in which the colored content liquid is released.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

Figure 3:
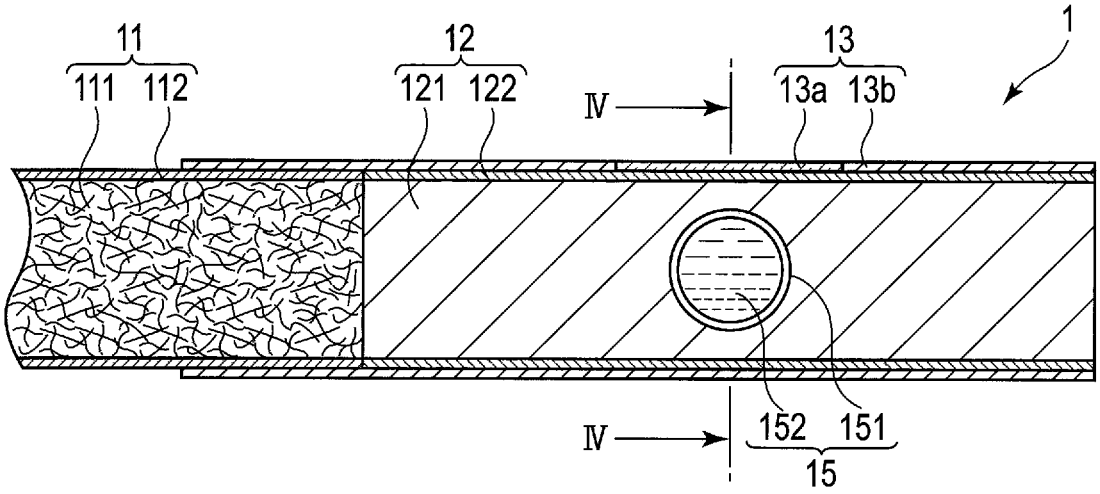
FIG. 3 is an enlarged schematic cross-sectional view showing a cross section taken along line in FIG. 2.
Figure 4:
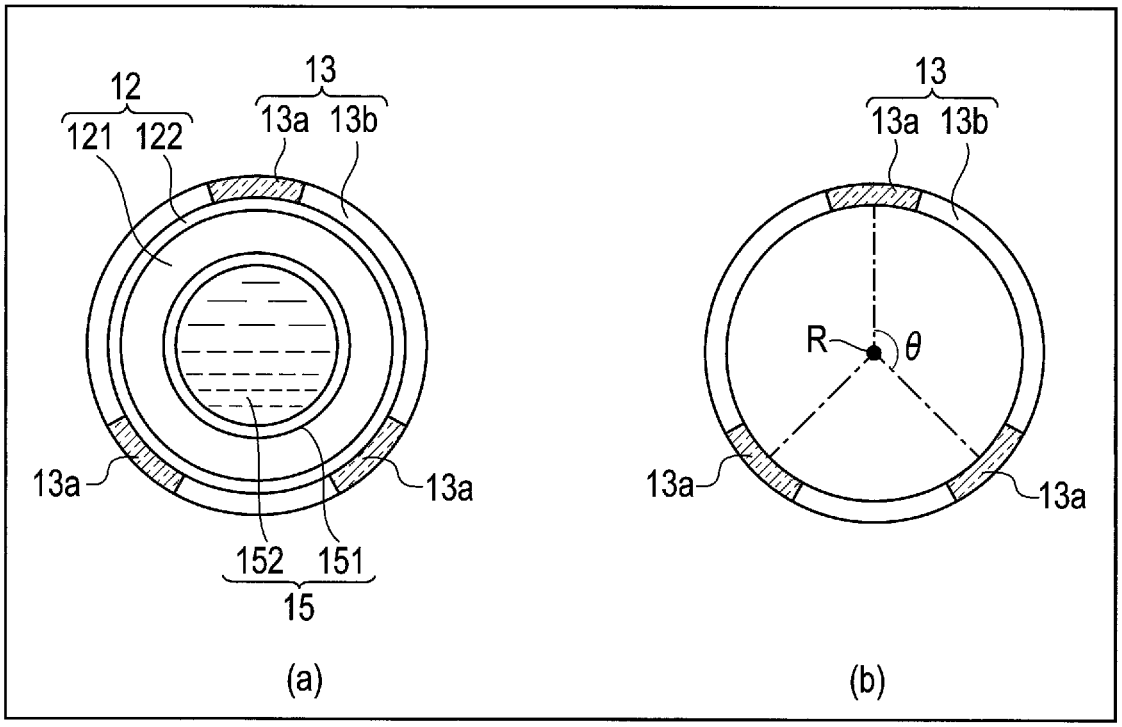

(a) of FIG. 4 is an enlarged schematic cross-sectional view showing a cross section taken along line IV-IV in FIG. 3, and (b) of FIG. 4 is a view schematically showing arrangement of transparent parts of (a).

Figure 5:
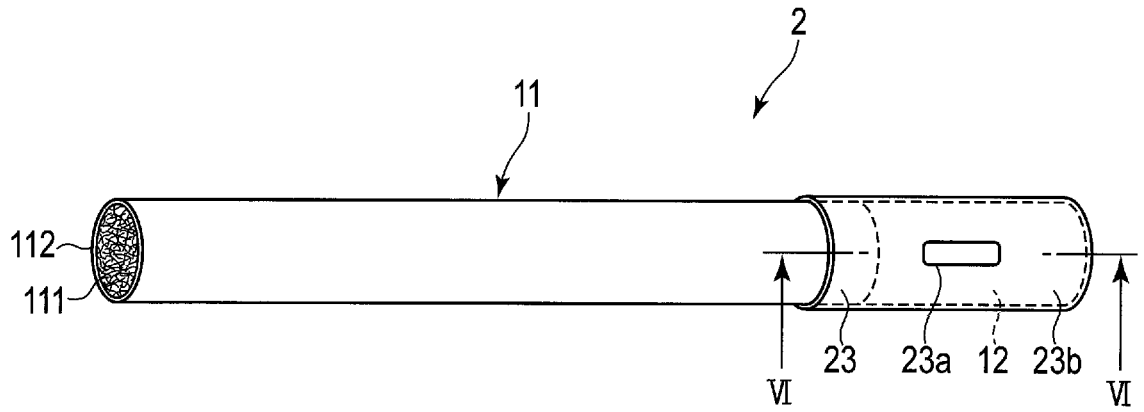

FIG. 5 is a schematic perspective view of a filtered smoking article according to a second embodiment.

Figure 6:
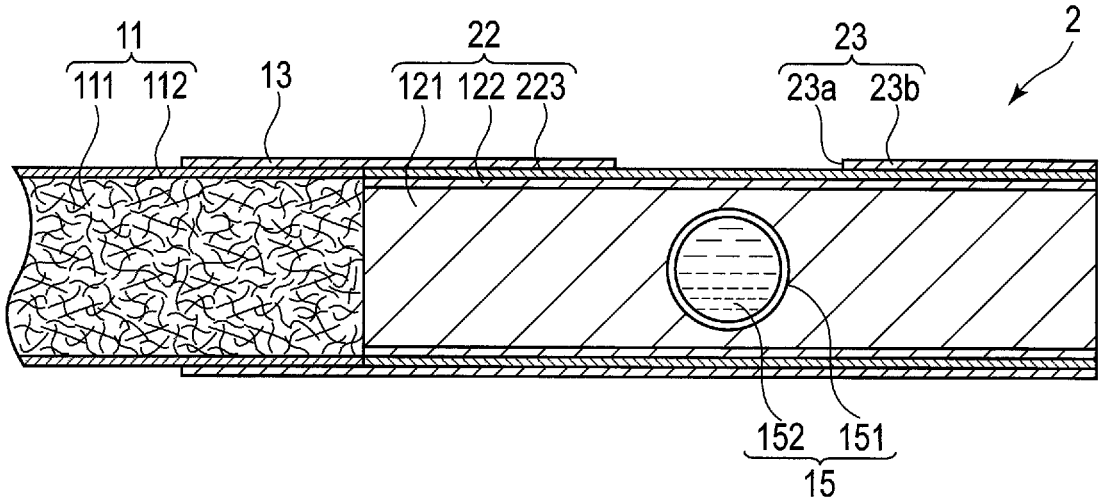

FIG. 6 is an enlarged schematic cross-sectional view showing a cross section taken along line VI-VI in FIG. 5.

Figure 7:
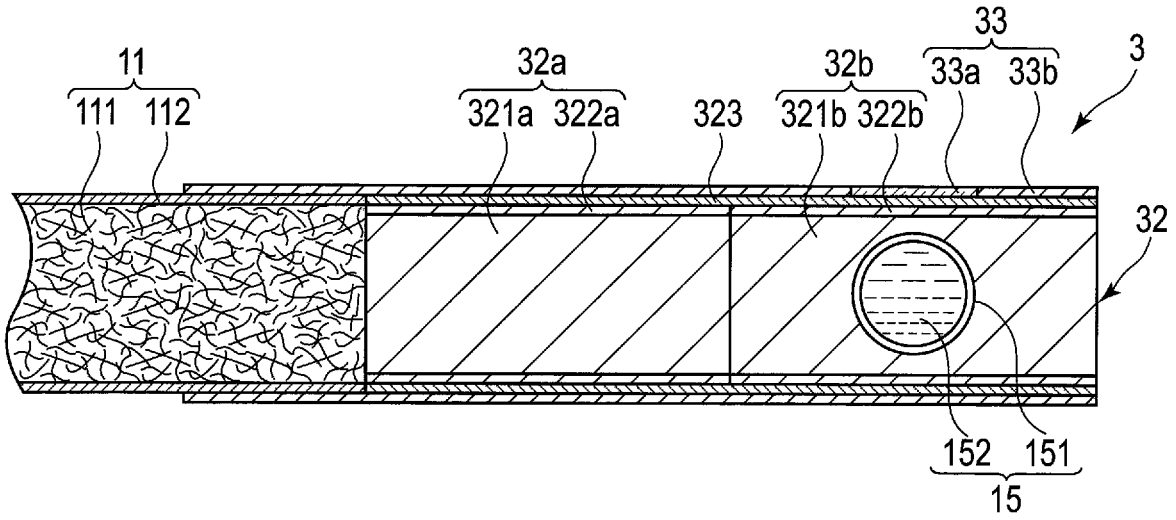

FIG. 7 is an enlarged schematic cross-sectional view showing a part of a filtered smoking article according to a third embodiment.

Figure 8:
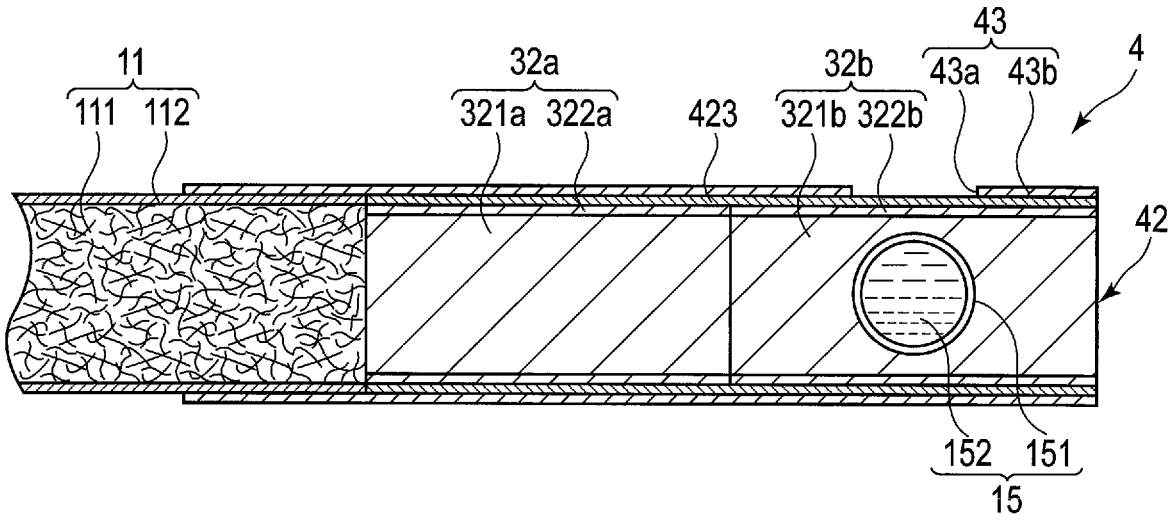

FIG. 8 is an enlarged schematic cross-sectional view showing a part of a filtered smoking article according to a fourth embodiment.

Figure 9:
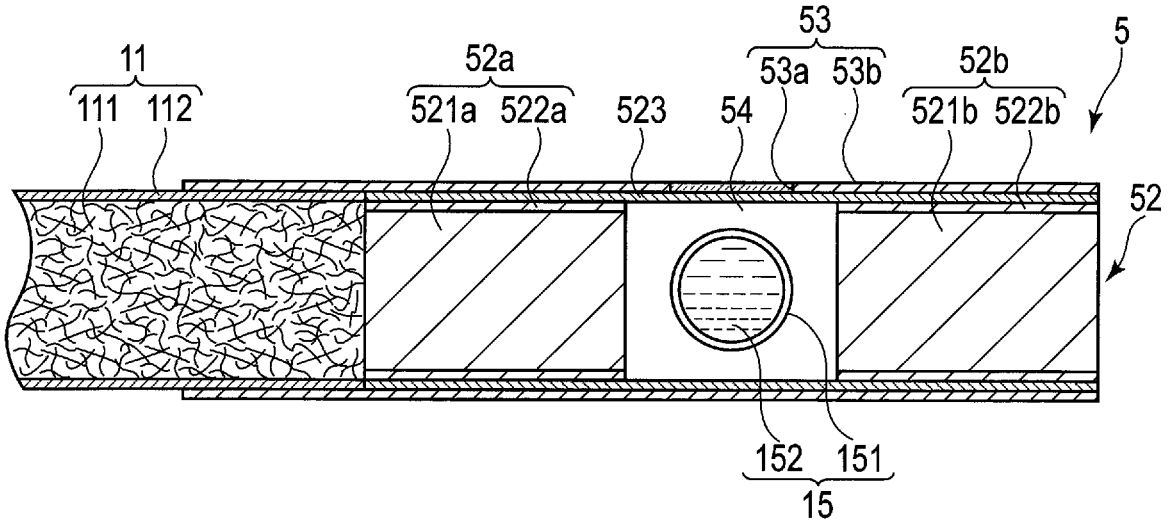

FIG. 9 is an enlarged schematic cross-sectional view showing a part of a filtered smoking article according to a fifth embodiment.

Figure 10:
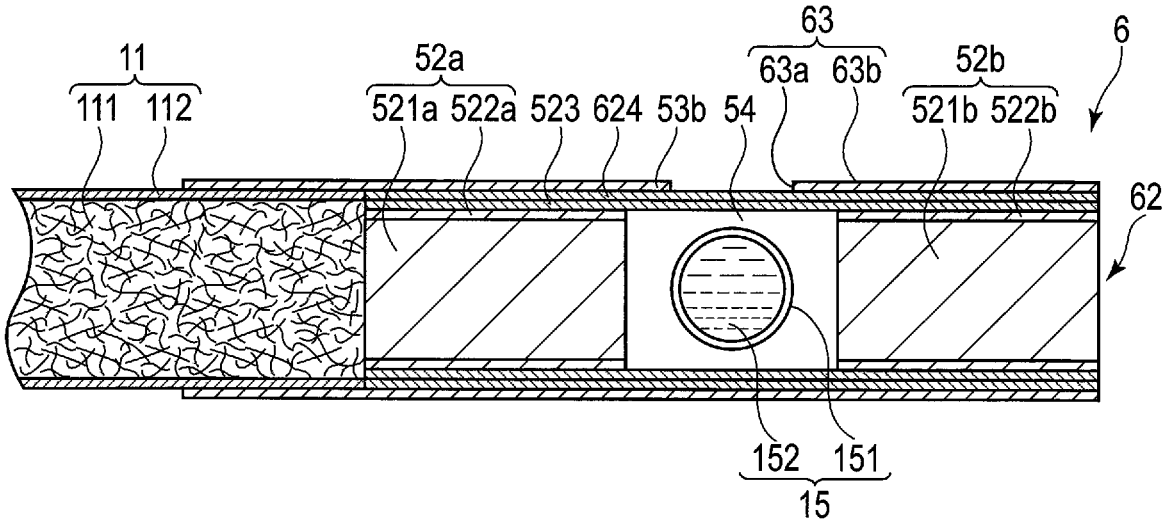

FIG. 10 is an enlarged schematic cross-sectional view showing a part of a filtered smoking article according to a sixth embodiment.

Figure 11:
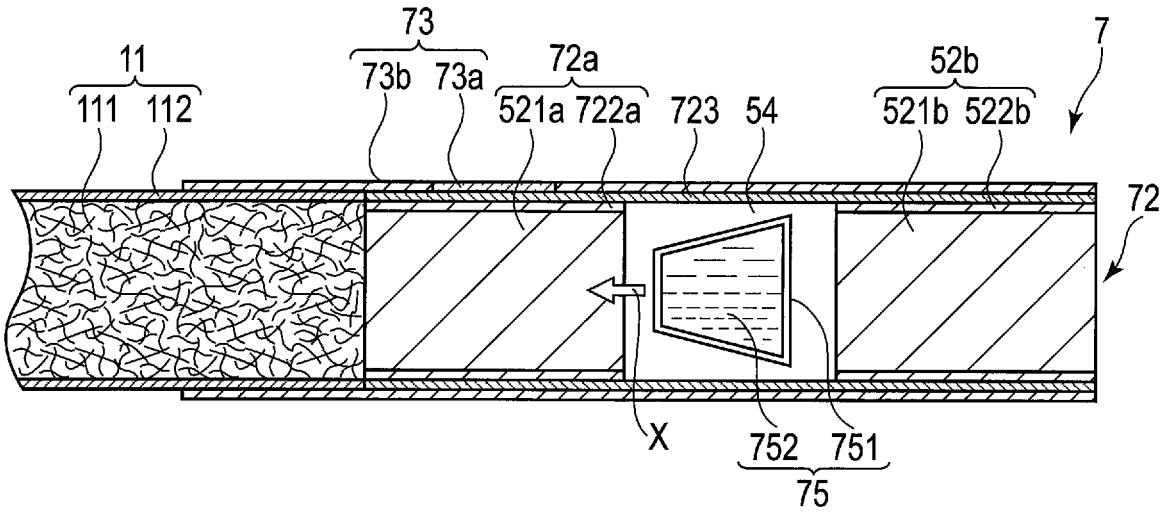

FIG. 11 is an enlarged schematic cross-sectional view showing a part of a filtered smoking article according to a seventh embodiment.

Figure 12:
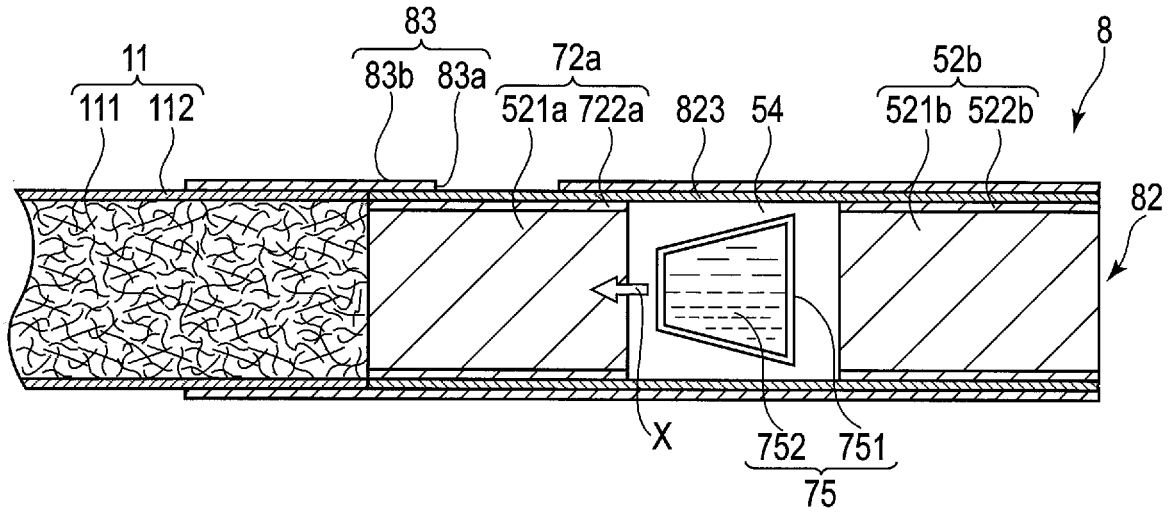

FIG. 12 is an enlarged schematic cross-sectional view showing a part of a filtered smoking article according to an eighth embodiment.

Figure 13:
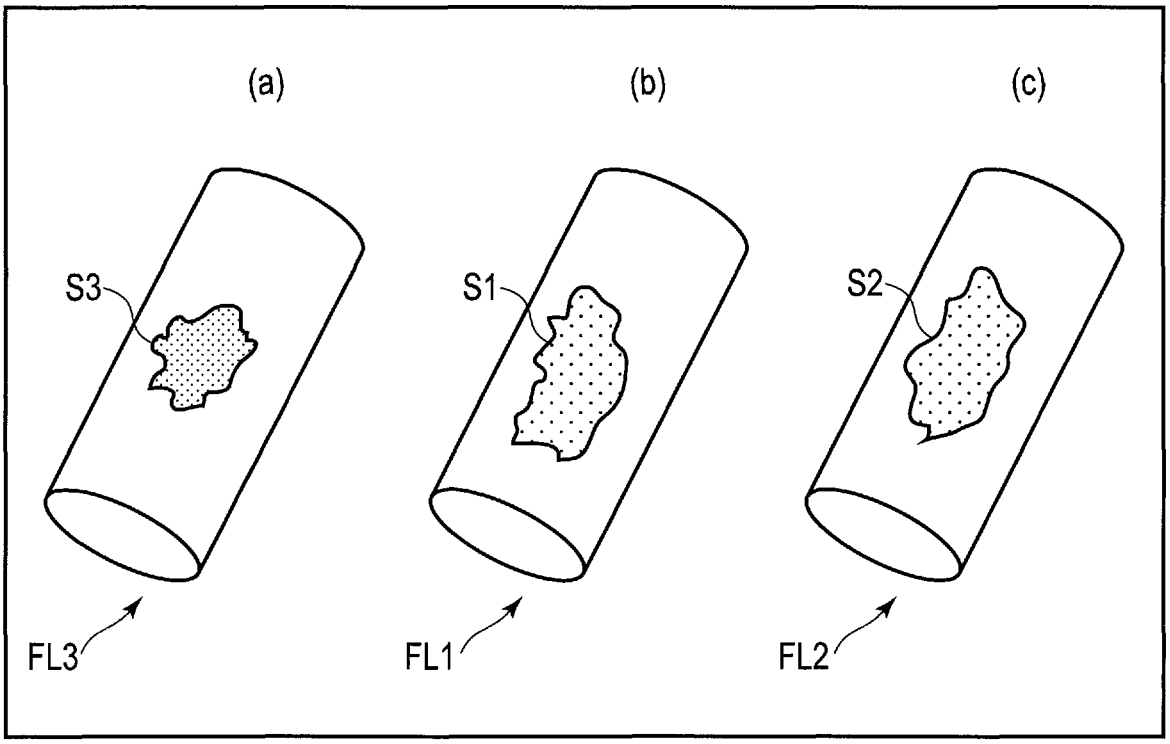

(a) to (c) of FIG. 13 are schematic views showing results of test samples 1 to 3 of Test Example 1.

Figure 14:
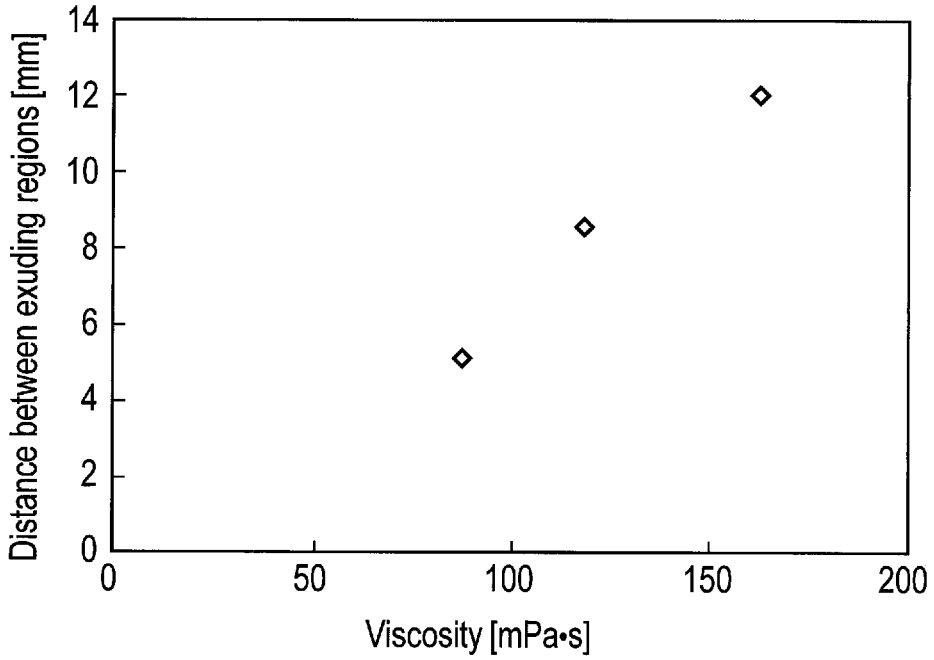

FIG. 14 is a graph showing a relationship between the viscosity of a colored content liquid of a flavor capsule in a test sample, and a distance between exuding regions of the colored content liquid in the filter winding sheet.

Figure 15:
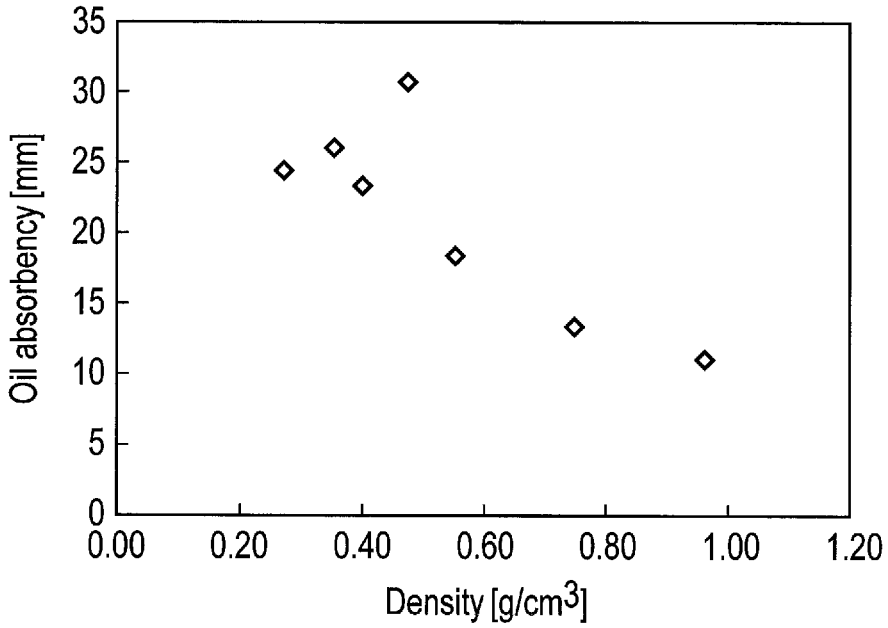

FIG. 15 is a graph showing a relationship between the density of paper and the oil absorbency by the Klemm method.

DETAILED DESCRIPTION OF THE INVENTION

Embodiments will be described hereinafter with reference to the accompanying drawings. Common constituent elements are denoted by the same reference numbers or symbols throughout the embodiments, duplicate explanations being omitted. Each figure is a schematic view for promoting understanding of the embodiment, and the shapes, dimensions, ratios and the like may be different from actual values. As used herein, terms "upstream" and "downstream" are used as appropriate, based on the direction of mainstream smoke flow when smoking a filtered smoking article.

First Embodiment

Figure 1:
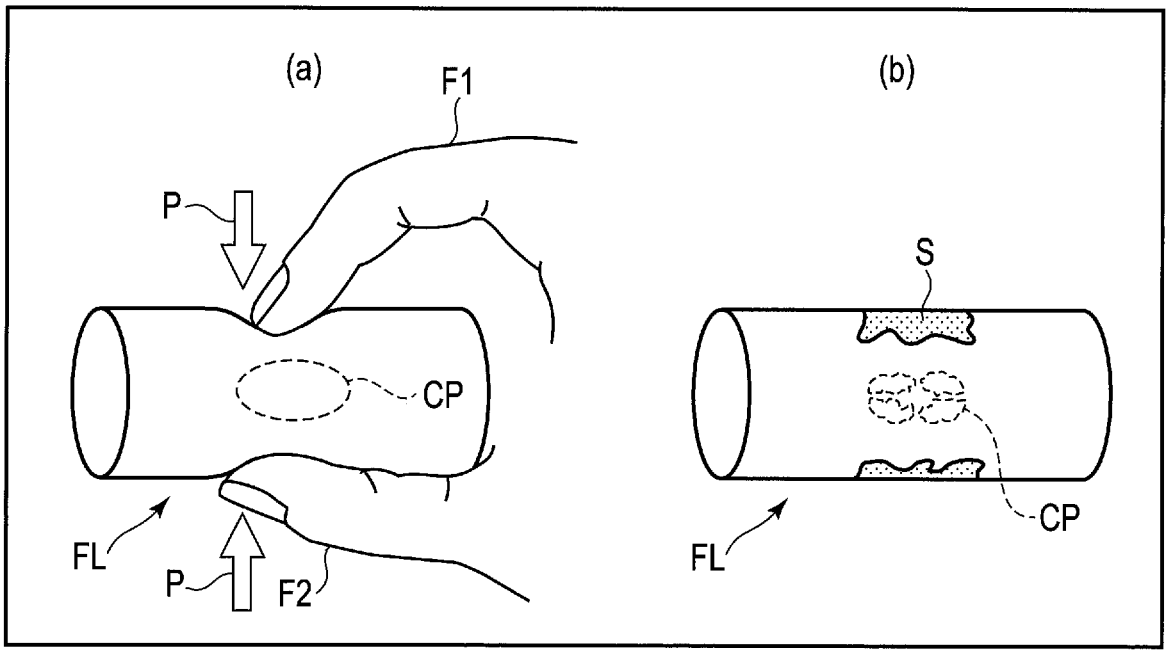
FIG. 1 is a schematic view showing a state of crushing a flavor capsule arranged inside the filter.
Figure 2:
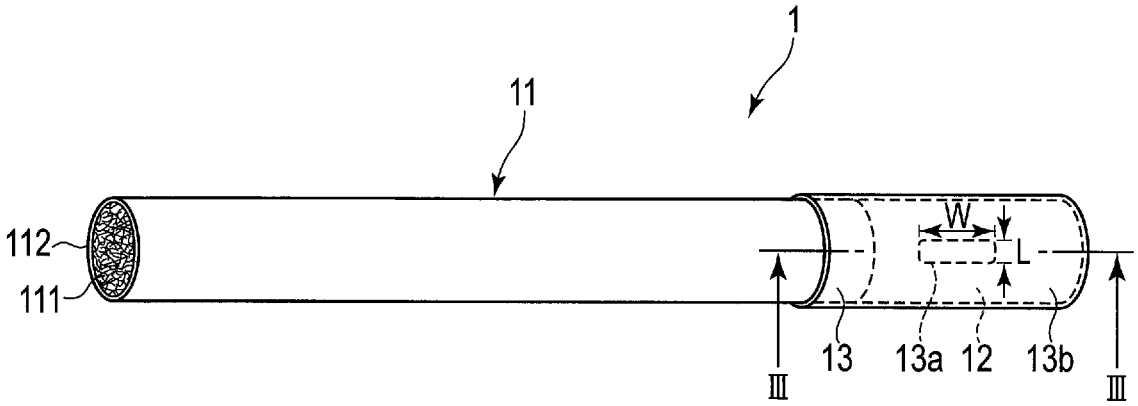
FIG. 2 is a schematic perspective view of a filtered smoking article according to the first embodiment.

FIG. 2 is a schematic perspective view of a filtered smoking article 1 according to the first embodiment. FIG. 3 is an enlarged schematic cross-sectional view showing a cross section taken along line of FIG. 2. (a) of FIG. 4 is an enlarged schematic cross-sectional view showing a cross section taken along the line IV-IV of FIG. 3, and (b) of FIG. 4 schematically shows the arrangement of transparent parts of (a) of FIG. 4. The filtered smoking article 1 comprises a smoking body 11, a filter 12, and a tipping paper 13.

The smoking body 11, for example, the cigarette rod 11 is composed of a shredded tobacco 111 and a cigarette paper 112 wound around the shredded tobacco 111, similarly to normal cigarette. The cigarette paper 112 is, for example, air-permeable paper.

The filter 12 is arranged at a downstream end of the cigarette rod 11. The filter 12 has the same or substantially the same diameter as the cigarette rod 11. The filter 12 comprises a filter member 121 having a single structure, a filter wrap sheet 122 wound around an outer peripheral surface of the filter member 121, and a flavor capsule 15 arranged inside the filter member 121. That is, the filter 12 has a so-called mono filter structure including the single filter member 121.

The filter member 121 is composed of, for example, cellulose acetate fibers.

The filter wrap sheet 122 is air-permeable paper, and is arranged so as to be opposed to a region in which the colored content liquid therein is released when the flavor capsule 15 is crushed. The air-permeable paper is the paper having air permeability of 1,000 C.U. to 30,000 C.U. The air-permeable paper has the air permeability of, preferably 1,000 C.U. to 24,000 C.U., and more preferably 1,000 C.U. to 10,000 C.U. As used therein, the air permeability is a value measured in conformity with ISO 2965:2009, and represents a flow rate ($cm^3$) of the gas passing the area of 1 $cm^2$ per minute when the pressure difference between both sides of the paper is 1 kPa. One coresta unit (1 C.U.) is $cm^3/(min \cdot cm^2)$ under 1 kPa.

The opacity of the air-permeable paper is preferably 30% or more, more preferably 40% or more and 70% or less, and more preferably 50% or more and 60% or less. In such an air-permeable paper having an opacity of 30% or more, a clear color is exhibited when the colored content liquid 152 of the flavor capsule 15 permeates into the paper. As used herein, the opacity is a value obtained by measuring brightness and opacity in conformity with ISO 2470 and ISO 2471, respectively, using a brightness and opacity measurement machine (manufacturer: Murakami Color Research Laboratory, model number: WMS-1). The opacity is a value obtained by a calculation formula: single sheet luminous reflectance factor (R0)/intrinsic luminous reflectance factor (R∞)×100(%). The intrinsic luminous reflectance factor (R∞) of this formula is the intrinsic reflectance factor of the brightness measured under spectral conditions that an effective wavelength is 457 nm and a half width is 44 nm by using a specified refractometer and a specified light source.

The air-permeable paper is not particularly limited as long as it has the above-mentioned physical properties, but examples of the paper are, for example, LPWS-OLL (basis weight: 26.5 gsm, air permeability: 1,300 C.U., and thickness: 48 μm) which is the paper manufactured by Nippon Paper Papylia Co., Ltd.), S52-7000 (basic weight: 52 gsm, air permeability: 7,000 C.U., and thickness: 110 μm) which is the paper manufactured by Nippon Paper Papylia Co., Ltd., and P-10000C (basis weight: 24 gsm, air permeability: 10,000 C.U., and thickness: 60 μm), P-20000C (basis weight: 26.5 gsm, air permeability: 20,000 C.U., thickness: 75 μm), P-30000C (basis weight: 21 gsm, air permeability: 30,000 C.U., thickness: 77 μm), PW/TCF/12000-27.50×4500 m (basis weight: 25 gsm, air permeability: 24,000 C.U., and thickness: 71 μm), and PPW 240 E2 26,50/4500 (basis weight: 21.5 gsm, air permeability: 24,000 C.U., thickness: 70 μm) which are high air-permeability unwoven fabrics manufactured by Nippon Paper Papylia Co., Ltd.

The flavor capsule 15 is arranged inside the filter 12, for example, and embedded at the center in a cross section perpendicular to the longitudinal direction of the filter member 121. The flavor capsule 15 includes a capsule body 151 and a colored content liquid 152 which is held in the capsule body 151 and contains a flavor component. In this example, "colored" means any color, but is preferably a color such as red, orange, yellow, blue, or green. The flavor capsule 15 is a frangible flavor capsule which allows the capsule body 151 to be crushed by receiving an external force and can release the colored content liquid 152 therein. As the material of the capsule body 151, for example, starch, dextrin, polysaccharide, agar, gellan gum, gelatin, various resin materials (polyvinyl chloride, polyvinylidene chloride, polystyrene, styrene-acrylonitrile copolymer, styrene-butadiene-acrylonitrile copolymer, polyethylene, polypropylene, cellulose acetate, polyethylene terephthalate, polyamide, ethylene-acrylic acid plastic, ethylene-vinyl acetate plastic, ethylene-vinyl alcohol plastic), various natural gelling agents and the like can be used. The capsule body 151 can further contain a flavor component, a plasticizer, a colorant and the like in addition to the above-mentioned materials. The shape of the flavor capsule 15 is not particularly limited, and may be spherical, cylindrical, or truncated cone. The flavor capsule may have, for example, a spherical shape having a diameter of 2 mm to 5 mm, or a cylindrical shape having a diameter of 5 mm to 7 mm and a length of 5 mm to 10 mm.

As the flavor component, for example, menthol, a vegetable essential oil, and the like can be used. One of forms of the colored content liquid 152 includes a colorant in addition to the flavor component. For example, various synthetic colorants and natural colorants can be used as the colorant in the colored content liquid 152. Specific colorants are preferably food additives such as red No. 3,106, beta-carotene (orange) copper chlorophyllin (green), gardenia blue pigment, yellow No. 4 and the like. The colored content liquid 152 can further include a solvent that dissolves the flavor component and the coloring agent. As the solvent, medium-chain fatty acid triglyceride (MCT) (for example, caprylic acid and caprylic acid triglyceride), glycerin, propylene glycol, water, ethanol or the like can be used. The colored content liquid 152 may further contain other additives such as an emulsifier and a thickener. A colored vegetable essential oil can be used as a flavor component. In addition, a colored solvent can be used as the solvent. In these forms, the colored content liquid 152 may not necessarily contain a colorant.

In addition, when the flavor capsule 15 is crushed, the colored content liquid 152 is released and permeates into the filter member 121 and the filter wrap sheet 122 which is air-permeable paper. For this reason, the color content liquid 152 preferably has the viscosity of 120 mPa·s or less, more preferably 90 mPa·s or less to increase the permeability into the filter member or the like.

Furthermore, considering that the colored content liquid sufficiently permeates into the air-permeable paper through the filter member 121 when the colored content liquid 152 is released after crushing the flavor capsule 15, it is preferable that the value of the amount of colored content liquid/cross-sectional area of the filter be set to 0.2 $\mu l/mm^2$ or more, more preferably 0.3 $\mu l/mm^2$ or more and 0.7 $\mu l/mm^2$ or less. It is unpreferable that the value of the amount of colored content liquid/cross-sectional area of the filter be less than 0.2 $\mu l/mm^2$, since the colored content liquid 152 of the flavor capsule 15 may become insufficient with respect to the volume of the filter and may not permeate into the filter wrap sheet 122 which is the air-permeable paper. In contrast, it is unpreferable that the value of the amount of colored content liquid/cross-sectional area of the filter be 2.2 $\mu l/mm^2$ or more, since the amount of colored content liquid 152 of the flavor capsule 15 becomes excessive with respect to the volume of the filter and the colored content liquid may reach the downstream end of the filter and adhere to the smoker's lips. The amount of the colored content liquid 152 of the flavor capsule 15 is, for example, 3 μl to 100 μl. In addition, the cross-sectional area of the filter 12 is, for example, 20 $mm^2$ to 50 $mm^2$.

The manufacturing method of the flavor capsule 15 is not specifically limited but, for example, a dropping method is preferably employed. The dropping method can produce a flavor capsule 15 having a seamless capsule body 151 having no seams. In this dropping method, the color content liquid 152 can be wrapped by the seamless capsule body 151 by simultaneously discharging the colored content liquid 152 from the inner nozzle and discharging a liquid coating material from the outer nozzle using a double nozzle. The flavor capsule 15 may be in a form of wrapping the content liquid (containing no colorant) in the capsule body containing the colorant, and the colorant of the capsule body may be dissolved and transferred to the content liquid during storage to form a colored content liquid.

The tipping paper 13 is wound around the outer peripheral surface of the downstream end part of the cigarette rod 11 and the outer peripheral surface of the filter 12 to connect the cigarette rod 11 and the filter 12. The tipping paper 13 has a transparent part 13*a* and an opaque part 13*b*. As shown in (a) of FIG. 4, at least three transparent parts 13*a* of the tipping paper 13 are arranged along the circumferential direction of the tipping paper 13 so as to be spaced apart from each other. Each of the transparent parts 13*a* is arranged to be opposed to the region in which the colored content liquid is released. The transparent parts 13*a* of the tipping paper 13 are preferably arranged at positions along the circumferential direction of the cross section perpendicular to the longitudinal direction of the filter 12. In particular, as shown in (b) of FIG. 4, transparent parts 13*a* of the tipping paper 13 are more preferably arranged such that the angular intervals θ of the adjacent transparent parts 13*a* is 150° or less as viewed from central point R in the cross section perpendicular to the longitudinal direction of the filter 12. By thus arranging the transparent parts 13*a* at an angular interval of 150° or less, the arrangement balance of the plurality of transparent parts 13*a* is made preferable. The angular interval θ is more preferably 140° or less, still more preferably 130° or less, and most preferably 120° or less. Three to eight, more preferably three to five transparent parts 13*a* of the tipping paper 13 are preferably arranged along the circumferential direction of the tipping paper 13.

In the relationship between the number of transparent parts 13*a* of the tipping paper 13 and the arrangement of their angular intervals θ, when, for example, three transparent parts 13*a* are arranged along the circumferential direction of tipping paper 13 and an angular interval θ1 between the adjacent first and second transparent parts 13*a* is set to 150°, the angular intervals θ2 between the adjacent third and the first transparent parts 13*a* and θ3 between the adjacent third and second transparent parts 13*a* are totally 210° (360°-150°, and the third transparent port 13*a* is arranged such that the total angular interval 210° is arbitrarily distributed in a range where the angular interval θ2 with respect to the first transparent part 13*a* and the angular interval θ3 with respect to the second transparent part 13*a* are 150° or less. That is, the third transparent part 13*a* is arranged along the circumferential direction of the tipping paper 13 at an angular interval θ2 of 60° to 150° with respect to the first transparent part 13*a* and at an angular interval θ3 of 60° to 150° with respect to the second transparent part 13*a*. By thus arranging the three transparent parts 13*a*, the exhibited color of the air-permeable paper can be quickly recognized visually through at least one transparent part 13*a* of the three transparent parts 13*a*, even if pressure is applied at any positions on the circumference of the filter 12 to crush the flavor capsule 15. In particular, when three transparent parts 13*a* are arranged along the circumferential direction of the tipping paper 13, the parts are preferably arranged at equal angular intervals, that is, at angular intervals of 120°. In addition, when four or five transparent parts are arranged along the circumferential direction of the tipping paper, the angular intervals of adjacent transparent parts 13*a* are preferably arranged at equal angular intervals, that is, at angular intervals of 90° or 72°, respectively.

In the form in which each of the transparent parts 13*a* of the tipping paper 13 is arranged to be opposed to a release region of the colored content liquid, the transparent parts 13*a* are preferably arranged so as to include parts facing the flavor capsule 15 in the configuration of the filtered smoking article 1 shown in FIG. 2 to FIG. 4. In this case, when the flavor capsule 15 is crushed and the colored content liquid 152 is released, the colored part can be easily visually recognized through the transparent parts 13*a*.

As shown in FIG. 2, each transparent part 13*a* of the tipping paper 13 preferably has a shape in which length W in the longitudinal direction of the filter 12 is larger than the length L along the circumferential direction of the tipping paper 13. In this case, even if the arrangement position of the flavor capsule 15 is displaced in the longitudinal direction of the filter 12, the colored part can easily be visually recognized through the transparent part 13*a* when the flavor capsule 15 is crushed and the colored content liquid 152 is released. The transparent part 13*a* preferably has a length L of 1 mm to 4 mm and a length W of 2 mm to 8 mm. For example, the transparent part 13*a* has a rectangular shape having a length L of 3 mm and a length W of 5 mm. It is aesthetically unpreferable that when the area of the transparent part 13*a* is too large, the colored content liquid of the flavor capsule 15 may not sufficiently permeate into a region that can be visually recognized since the area of the air-permeable paper that can be visually recognized from the outside increases. FIG. 2 shows an example of the rectangular transparent part 13*a*, but the shape of the transparent part 13*a* is not limited to this but may be, for example, characters, geometric shapes, logo marks, and the like. The lengths L and W in the geometric shape or the like are the lengths L and W when approximated by a circumscribed figure.

The tipping paper 13 can be formed by, for example, using an entirely transparent base sheet and printing opaque ink on a region other than the transparent part 13*a* by, for example, gravure printing or ink-jet printing. The opaque ink may be printed on both sides of the base sheet or may be printed on either side. It is preferable to print the opaque ink only on the inner surface of the base sheet of the tipping paper 13, since making the opaque ink adhere to the smoker's lips at the time of smoking and giving discomfort can be avoided. In addition, when the opaque ink is printed only on the inner surface of the base sheet of the tipping paper 13, the smoker visually recognizes the opaque part 13*b* through the base sheet. For this reason, different texture can be realized as compared with a case where the opaque ink is printed on the outer surface of the base sheet of the tipping paper 13. The color of the opaque part 13*b* is not particularly limited but can be, for example, the same color as the filter member 121. The tipping paper 13 is not limited to the above-described configuration but, for example, the transparent part 13*a* may be formed by cutting out a part of the sheet constituting the opaque part 13*b* and ploughing a transparent sheet into the part.

The tipping paper 13 is impermeable to the colored content liquid 152 of the flavor capsule 15. The tipping paper 13 includes, for example, a base sheet which is entirely transparent and is impermeable to the colored content liquid 152 of the flavor capsule 15. The base sheet is, for example, a cellophane, a polyolefin film such as a polypropylene film, a polyvinyl chloride film, or a cellulose acetate film. In the base sheet, a liquid impermeable layer may be formed by applying a resin such as nitrocellulose, ethyl cellulose, polyvinyl alcohol, or polyvinyl acetate, or a liquid impermeable layer may be formed using a substance having low affinity with the colored content liquid 152, on the front surface, the back surface, or both of the surfaces. For example, when medium-chain fatty acid (MCT) is a main component as a solvent of the colored content liquid 152, polysaccharides having relatively hydrophilic properties such as starch, modified starch, pectin, sodium alginate, gellan gum, tamarind gum, and carrageenan can be used as the material of the liquid impermeable layer. The tipping paper 13 is impermeable to the colored content liquid 152 and thereby the colored content liquid 152 can be prevented from permeating into the outer surface of the tipping paper 13, and the colored content liquid 152 can be prevented from adhering to the lips and hands of the smoker. By forming the liquid impermeable layer, when the colored content liquid permeates the base sheet, the effect of preventing the base sheet from swelling and affecting the cigarette quality is also expected.

Examples of the base sheet of the tipping paper 13 include, for example, cellophane such as P-BD #600 (trade name), P-BD #500 (trade name) and P-BD #300 (trade name) manufactured by Futamura Chemical Industries, Co., Ltd., a cellulose diacetate film which is Clarifoil (registered trademark) manufactured by Celanese Corporation, a polyolefin film which is T.A.F (registered trademark) and a biaxially oriented polypropylene film which is HC-OP, both manufactured by Mitsui Chemicals Tohcello, Inc., and the like.

The tipping paper 13 is made to adhere to the cigarette rod 11 and the filter 12 by a conventional adhesive used in the manufacture of a general filtered smoking article. The type of the adhesive for bonding the tipping paper 13 to the cigarette rod 11 and the filter 12 is not particularly limited, and a vinyl acetate adhesive, a starch or a modified starch adhesive may be used or an adhesive that is substantially transparent when dried may be used. In addition, the region to which the adhesive is applied may be an entire region of the adhesive surface, or may include a region in which the adhesive is not partially applied, as long as the purpose of connecting the cigarette rod 11 and the filter 12 with the tipping paper 13 can be achieved.

Furthermore, the tipping paper 13 preferably has a basis weight of 20 gsm to 100 gsm, more preferably 25 gsm to 50 gsm such that, when the tipping paper 13 is wound around the downstream end part of the cigarette rod 11 and the outer peripheral surface of the filter 12, the tipping paper 13 is hard to break and the tipping paper 13 can be wound according to the shape of the filtered smoking article. For the same reason, the tipping paper 13 preferably has a thickness of 15 μm to 80 μm, more preferably 18 μm to 40 μm.

The effects of the filtered smoking article 1 according to the first embodiment will be described.

When smoking the filtered smoking article 1, mainstream smoke from the cigarette rod 11 passes through the filter 12 and is released from the downstream end of the filter 12. The smoker holds the filter 12 with, for example, a forefinger and a thumb, and presses it to crush the capsule body 151 in the filter 12, to crush the flavor capsule 15, and to release the colored content liquid 152 from the flavor capsule 15 into the filter member 121. Thus, the smoker can enjoy the smell of the flavor component added to the mainstream smoke from the cigarette rod 11. When the colored content liquid 152 of the flavor capsule 15 is released to the filter member 121, the colored content liquid 152 reaches the filter wrap sheet 122 formed of air permeability paper, which is arranged opposite to the release region. At this time, since the filter wrap sheet 122 formed of air permeability paper has a specific air permeability of 1,000 C.U. to 30,000 C.U., the sheet can make the colored content liquid quickly penetrate and diffuse over a wide area of the air-permeable paper by a high permeability of the capillary phenomenon. In addition, when the filter wrap sheet 122 formed of air-permeable paper having a specific opacity of 30% or more is used, the sheet 122 can exhibit a clear color to improve visual recognition when the colored content liquid 152 penetrates. As a result, the smoker can easily visually recognize the filter wrap sheet 122, which is air-permeable paper made to rapidly exhibit a clear color, from the outside through the transparent part 13*a* of the tipping paper 13, and can quickly confirm crushing of the flavor capsule 15.

In addition, the tipping paper 13 wound around the outer peripheral surface of the filter member 121 comprises at least three transparent parts 13*a* arranged to be spaced apart from each other along the circumferential direction of the surface, if the transparent parts 13*a* are arranged such that the angular interval of the adjacent transparent parts 13*a* is 150° or less when viewed from the center point in the cross section perpendicular to the longitudinal direction of the filter 12 and even if pressed from any positions in the circumferential direction of the filter 12 when the flavor capsule 15 is crushed, the colored state of the filter wrap sheet 122 serving as the air-permeable paper with the colored content liquid 152 can be visually recognized through the at least one transparent part 13*a* of the three transparent parts 13*a*. As a result, the smoker can visually recognize the crushed state of the flavor capsule 15 with a higher probability.

Therefore, according to the first embodiment, the filtered smoking article that enables the smoker to enjoy the flavor component in the flavor capsule 15 while visually recognizing crushing of the flavor capsule 15 and the sufficient release of the colored content liquid 152 into the filter 12, which occurs together with the crushing, can be provided.

In the first embodiment, the example of the configuration that the air-permeable sheet is wound on the filter member and the tipping paper is wound on the air-permeable sheet has been described, but the present invention is not limited to this. The air-permeable paper may be wound around the outside of the filter member, and the other layer may be interposed between the filter member and the air-permeable paper as long as the function of quickly penetrating and diffusing the colored content liquid is not impaired. In addition, the tipping paper may be wound along the outer peripheral surface of the filter, and the other layer may be interposed between the air-permeable paper and the tipping paper as long as visually recognizing the colored content liquid permeating and diffusing into the air-permeable paper through the transparent part is not impaired.

In the first embodiment, the example of the configuration that the single flavor capsule is arranged inside the filter has been described, but the present invention is not limited to this. A plurality of flavor capsules may be arranged inside the filter. In this case, the amount of colored content liquid in the value of the amount of colored content liquid/cross-sectional area of the filter indicates the total amount of colored content liquid of a plurality of flavor capsules.

Smoking articles such as cigarettes and their formats are generally named as follows according to the length of the cigarettes. "Standard" is indicative of cigarettes generally having a length in the range of 68 mm to 75 mm, for example approximately 68 mm to approximately 72 mm, "short" or "mini" is indicative of cigarettes having a length of 68 mm or less, "king size" is indicative of cigarettes generally having a length in the range of 75 mm to 91 mm, for example approximately 79 mm to approximately 88 mm, "long" or "super king" is indicative of cigarettes generally having a length in the range of 91 mm to 105 mm, for example approximately 94 mm to approximately 101 mm, and "ultra long" is indicative of cigarettes generally having a length in the range of approximately 110 mm to approximately 121 mm. In addition, the smoking articles are also named below according to the cigarette circumference. "Standard" is indicative of cigarettes having a circumference of approximately 23 mm to 25 mm, "wide" is indicative of cigarettes having a circumference of 25 mm or more, "slim" is indicative of cigarettes having a circumference of approximately 22 mm to 23 mm, "demi-slim" is indicative of cigarettes having a circumference of approximately 19 mm to 22 mm, "super slim" is indicative of cigarettes having a circumference of approximately 16 mm to 19 mm, and "micro-slim" is indicative of cigarettes having a circumference of less than approximately 16 mm. Therefore, the cigarettes of a king size and super slim type have, for example, a length of approximately 83 mm and a circumference of approximately 17 mm. Standard and king-sized cigarettes, i.e., cigarettes having a length of 75 mm to 91 mm and a circumference of 23 mm to 25 mm, are preferred by a number of customers. The smoking articles of each format may be manufactured to include filters having different lengths. In general, short filters are used for smoking articles of the formats having a short length and a short circumference. In general, filter lengths range from 15 mm for use with smoking articles in "short" and "standard" formats, to 30 mm for use with smoking articles in "ultra long" and "super slim" formats. The length of the tipping paper in the longitudinal direction of the filtered smoking article is, for example, 3 mm to 10 mm longer than the filter.

Second Embodiment

FIG. 5 is a schematic perspective view of a filtered smoking article 2 according to the second embodiment. FIG. 6 is an enlarged schematic cross-sectional view showing a cross section taken along line VI-VI of FIG. 5. A filtered smoking article 2 according to the second embodiment has the same configuration as a filtered smoking article 1 according to the first embodiment except features that a filter 22 further comprises a second filter wrap sheet 223 on an outer surface of a first filter wrap sheet 122 and a configuration of tipping paper 23 is different from the first embodiment.

The filter 22 further comprises the second filter wrap sheet 223 which is a transparent plug wrapper wound around the outer peripheral surface of the first filter wrap sheet 122 which is air-permeable paper.

The transparent plug wrapper 223 is impermeable to a colored content liquid 152 of flavor capsule 15 and has a transparent part at least partially. The transparent plug wrapper 223 is, for example, entirely transparent, and is formed of the same material as the base sheet of the tipping paper 13 described in the first embodiment. The feature that the transparent plug wrapper 223 has a transparent part at least partially means that at least a part corresponding to an opening part 23*a* of the tipping paper 23 described later may be transparent. The entirely transparent plug wrapper 223 is, for example, a cellophane, a polyolefin film such as a polypropylene film, a polyvinyl chloride film, or a cellulose acetate film. In the transparent plug wrapper 223, a liquid impermeable layer may form by applying a resin such as nitrocellulose, ethyl cellulose, polyvinyl alcohol, or polyvinyl acetate, or a liquid impermeable layer may be formed using a substance having a low affinity with the colored content liquid 152, on the front surface, the back surface, or both of the surfaces. The transparent plug wrapper 223 is impermeable to the colored content liquid 152 and thereby the colored content liquid 152 can be prevented from permeating into the outer surface of the tipping paper 13, and the colored content liquid 152 can be prevented from adhering to the lips and hands of the smoker.

The tipping paper 23 is wound around the outer peripheral surface of the downstream end part of the cigarette rod 11 and the outer peripheral surface of the filter 22 to connect the cigarette rod 11 and the filter 22. The tipping paper 23 has an opening part 23*a*, and a part other than the opening part 23*a* is an opaque part 23*b*. The opening part 23*a* of the tipping paper 23 is formed in the same shape and arrangement as the transparent part 13*a* of the tipping paper 13 described in the first embodiment. That is, at least three opening parts 23*a* of the tipping paper 23 are arranged along the circumferential direction of the tipping paper 23 so as to be spaced apart from each other. Each of the opening parts 23*a* of the tipping paper 23 is arranged to be opposed to the region in which the colored content liquid is released. The opening parts 23*a* of the tipping paper 23 are arranged such that the angular intervals of the adjacent opening parts 23*a* is at 150° or less as viewed from a central point in the cross section perpendicular to the longitudinal direction of the filter 22. Each opening part 23*a* of the tipping paper 23 preferably has an elongated shape in which length W in the longitudinal direction of the filter is larger than the length L along the circumferential direction of the tipping paper 23. The opening 23*a* has, for example, a rectangular shape having a length L of 3 mm and a length W of 5 mm. FIG. 5 shows an example of the rectangular opening part 23*a*, but the shape of the opening part 23*a* is not limited to this but may be, for example, characters, geometric shapes, logo marks, and the like. The opening parts 23*a* of the tipping paper 23 preferably have a rate of less than 65% of the circumference of the tipping paper 23. It is unpreferable that the ratio of the openings 23*a* to the circumference of the tipping paper 23 is too large, since the strength of the tipping paper 23 decreases at the portion having the opening parts 23*a*.

In the form in which the opening parts 23*a* of the tipping paper 23 are arranged opposite to release regions of the colored content liquid, respectively, the opening parts 23*a* are preferably arranged so as to include parts facing the flavor capsule 15 in the configuration of the filtered smoking article 2 shown in FIG. 5 and FIG. 6. In this case, when the flavor capsule 15 is crushed and the colored content liquid 152 is released, the colored part can be easily visually recognized through the opening parts 23*a*.

The material constituting the tipping paper 23 is not particularly limited and, for example, the material of the tipping paper used for manufacture of a general filtered smoking article can be used. The opening 23*a* of the tipping paper 23 can be formed by, for example, cutting out a region other than the opaque part 23*b*.

In addition, the tipping paper 23 preferably has a basis weight of 20 gsm to 100 gsm, more preferably 25 gsm to 50 gsm, similarly to the tipping paper 13 described in the first embodiment. For the same reason, the tipping paper 13 preferably has a thickness of 15 μm to 80 μm, more preferably 18 μm to 40 μm.

In the filtered smoking article 2 according to the second embodiment, the same advantages as those of the filtered smoking article 1 according to the first embodiment can be obtained. That is, when the filter 12 is sandwiched between, for example, an index finger and a thumb and pressed to crush the flavor capsule 15 in the filter 12 and release the colored content liquid 152 to the filter member 121, the smoker can easily visually recognize the filter wrap sheet 122, which is air-permeable paper made to rapidly exhibit a clear color, from the outside through the opening part 23*a* of the tipping paper 23 and can quickly confirm crushing of the flavor capsule 15. In addition, the tipping paper 23 wound around the outer peripheral surface of the filter member 121 comprises at least three opening parts 23*a* arranged along the circumferential direction and spaced apart from each other and, if the opening parts 23*a* are arranged such that the angular interval of the adjacent opening parts 23*a* is 150° or less as viewed from the center point in the cross section perpendicular to the longitudinal direction of the filter 22, the smoker can visually recognize the state in which the colored content liquid 152 of the flavor capsule 15 is released in the filter 22 and the filter wrap sheet 122 which is air-permeable paper is colored, that is, the state in which the flavor capsule 15 is crushed, with higher probability.

In FIG. 5 and FIG. 6, the example of the configuration that the air-permeable paper is wound on the filter member, the transparent plug wrapper is wound on the air-permeable paper, and the tipping paper is further wound on the transparent plug wrapper has been described, but the present invention is not limited to this. The air-permeable paper may be wound around the outside of the filter member, and the other layer may be interposed between the filter member and the air-permeable paper as long as the function of rapidly penetrating and diffusing the colored content liquid is not impaired. In addition, the transparent plug wrapper may be wound on the outside of the air-permeable paper, and the other layer may be interposed between the air-permeable paper and the transparent plug wrapper as long as visually recognizing the colored content liquid permeating and diffusing into the air-permeable paper via the opening part is not impaired. In addition, the tipping paper may be wound along the outer peripheral surface of the filter, and the other layer may be interposed between the air-permeable paper and the tipping paper as long as visually recognizing the colored content liquid permeating and diffusing into the air-permeable paper via the opening part is not impaired.

Third Embodiment

FIG. 7 is an enlarged schematic cross-sectional view showing a part of a filtered smoking article 3 according to the third embodiment. The filtering smoking article 3 according to the third embodiment has the same configuration as the filtered smoking article 1 according to the first embodiment except that the configuration of the filter 32 and the configuration of the tipping paper 33 are different from the first embodiment.

The filter 32 is a so-called dual filter composed of a first filter segment 32*a* disposed on the upstream side and a second filter segment 32*b* disposed on the downstream side.

The first filter segment 32*a* comprises a filter member 321*a* and a first filter wrap sheet 322*a* wound around the outer surface of the filter member 321*a*. In the example shown in FIG. 7, the filter member 321*a* of the first filter segment 32*a* is a so-called charcoal filter in which an adsorbent, for example, activated carbon or the like is dispersedly added to gaps of fibers of a cellulose acetate fiber packed layer. The material of the first filter wrap sheet 322*a* is not particularly limited and, for example, plain paper can be used.

The second filter segment 32*b* comprises a filter member 321*b* and a second filter wrap sheet 322*b* wound around the filter member 321*b*. In the example shown in FIG. 7, the filter member 321*b* of the second filter segment 32*b* is a normal white filter member formed of acetate fibers. A flavor capsule 15 is embedded at the center of the cross section perpendicular to the longitudinal direction of the filter member 321*b*. The second filter wrap sheet 322*b* is the air-permeable paper described in the first embodiment, and is arranged so as to be opposed to the region in which the flavor capsule 15 is crushed and the colored content liquid 152 is released.

The first filter segment 32*a* and the second filter segment 32*b* are wound with a third filter wrap sheet 323 covering their outer peripheral surfaces and are thereby connected. The third filter wrap sheet 323 may be air-permeable paper, the transparent plug wrapper described in the second embodiment or plain paper. The third filter wrap sheet 323 is preferably air-permeable paper or transparent plug wrapper.

The tipping paper 33 is wound around the outer peripheral surface of the downstream end part of the cigarette rod 11 and the outer peripheral surface of the filter 32 to connect the cigarette rod 11 and the filter 32. The tipping paper 33 has a transparent part 33*a*, and a portion other than the transparent part 33*a* is an opaque part 33*b*. The tipping paper 33 has the same configuration as the tipping paper 13 described in the first embodiment except that the transparent part 33*a* is arranged to be opposed to the flavor capsule 15 inside the second filter segment 32*b* which is a release region of the colored content liquid.

In the filtered smoking article 3 according to the third embodiment, the same effects as the filtered smoking article 1 according to the first embodiment can be obtained. That is, for example, when the second filter segment 32*b* is sandwiched between an index finger and a thumb and pressed to crush the flavor capsule 15 inside the second filter segment 32*b* and release the colored content liquid 152 to the filter member 321*b* of the second filter segment 32*b*, a smoker can easily visually recognize the second filter wrap sheet 322*b*, which is the air-permeable paper rapidly colored in a clear color, from the outside through the transparent part 33*a* of the tipping paper 33 and can quickly confirm crushing of the flavor capsule 15.

In addition, when the filtered smoking article 3 is smoked and when the mainstream smoke from the cigarette rod 11 passes through the first filter segment 32*a* which is a charcoal filter, unpleasant flavor of the mainstream smoke is adsorbed into the activated carbon. Furthermore, when the mainstream smoke passes through the second filter segment 32*b*, the flavor capsule 15 is crushed to release the colored content liquid 152 in the flavor capsule 15 into the filter member 321*b* of the second filter segment 32*b*, and the flavor of the flavor component added to the mainstream smoke from the cigarette rod 11 can be enjoyed. The filter is thus provided with a plurality of filter segments 32*a* and 32*b*, and separate functions can be thereby assigned to the respective filter segments.

In the present embodiment, an example that the first filter segment (char filter segment) 32*a* is arranged on the upstream side and the second filter segment 32*b* is arranged on the downstream side has been described, but the first filter segment 32*a* may be arranged on the downstream side and the second filter segment 32*b* may be arranged on the upstream side.

In addition, the filter member of the filtered smoking article 3 may be a triple filter in which a filter segment having the other function is arranged at the middle of the first and second filter segments or the upstream end or the downstream end.

Fourth Embodiment

FIG. 8 is an enlarged schematic cross-sectional view showing a part of a filter smoking article 4 according to the fourth embodiment. The filtered smoking article 4 according to the fourth embodiment has the same configuration as the filtered smoking article 3 according to the third embodiment except that the configurations of the filter 42 and the tipping paper 43 are different from the third embodiment.

In the fourth embodiment, the transparent plug wrapper described in the second embodiment is used as a third filter wrap sheet 423 which is wound around an outer peripheral surface of a first filter segment 32*a* and a second filter segment 32*b* and which connects the filter segments 32*a* and 32*b*.

The tipping paper 43 is wound around an outer peripheral surface of the downstream end part of a cigarette rod 11 and an outer peripheral surface of the filter 42, and connects the cigarette rod 11 and the filter 42. The tipping paper 43 has an opening part 43*a*, and a portion other than the opening part 43*a* is an opaque part 43*b*. The tipping paper 43 has the same configuration as the tipping paper 23 described in the second embodiment except that the opening part 43*a* is arranged to be opposed to the flavor capsule 15 located inside the second filter segment 32*b* which is a release region of the colored content liquid.

In the filtered smoking article 4 according to the fourth embodiment, the same advantages as those of the filtered smoking article 3 according to the third embodiment can be obtained.

In addition, the filter member of the filtered smoking article 4 may be a triple filter in which a filter segment having the other function is arranged at the middle of the first and second filter segments or the upstream end or the downstream end.

Fifth Embodiment

FIG. 9 is an enlarged schematic cross-sectional view showing a part of a filter smoking article 5 according to the fifth embodiment. The filtered smoking article 5 according to the fifth embodiment has the same configuration as the filtered smoking article 1 according to the first embodiment except that the configurations of the filter 52 and the tipping paper 53 are different from the first embodiment.

The filtered smoking article 5 according to the fifth embodiment comprises two filter segments 52*a* and 52*b* arranged with a hollow portion (cavity) 54 sandwiched therebetween. A flavor capsule 15 is arranged in the hollow portion 54 of the filter 52.

The first filter segment 52*a* and the second filter segment 52*b* comprise filter members 521*a* and 521*b*, and a first filter wrap sheet 522*a* and a second filter wrap sheet 522*b* wound around the filter members 521*a* and 521*b*, respectively. Each of the filter members 521*a* and 521*b* is, for example, a normal white filter member formed of acetate fibers. Each of the first filter wrap sheet 322*a* and second filter wrap sheet 522*b* is, for example, plain paper.

The first and second filter segments 52*a* and 52*b* arranged with the hollow portion 54 sandwiched therebetween are connected by a third filter wrap sheet 523 which is wound around their outer peripheral surfaces including the hollow portion 54. The air-permeable paper described in the first embodiment is used as the third filter wrap sheet 523. That is, the third filter wrap sheet 523 is air-permeable paper, and is arranged close to a region in which the flavor capsule 15 located in the hollow portion 54 is crushed and the colored content liquid therein is released.

The tipping paper 53 is wound around the outer peripheral surface of the downstream end part of the cigarette rod 11 and the outer peripheral surface of the filter 52 to connect the cigarette rod 11 and the filter 52. The tipping paper 53 has a transparent part 53*a*, and a portion other than the transparent part 53*a* is an opaque part 53*b*. The tipping paper 53 has the same configuration as the tipping paper 13 described in the first embodiment except that the transparent part 53*a* is arranged to be opposed to the flavor capsule 15 arranged inside the hollow portion 54 which is a release region of the colored content liquid.

In the filtered smoking article 5 according to the fifth embodiment, the same advantages as those of the filtered smoking article 1 according to the first embodiment can be obtained. That is, when the filter 52 portion where the hollow portion 54 between the first filter segment 52*a* and the second filter segment 52*b* is located is sandwiched between, for example, an index finger and a thumb and pressed to crush the flavor capsule 15 inside the hollow portion 54 and release the colored content liquid 152 to the hollow portion 54 between the first filter segment 52*a* and the second filter segment 52*b*, a smoker can easily visually recognize the third filter wrap sheet 523, which is the air-permeable paper rapidly colored in a clear color, from the outside through the transparent part 53*a* of the tipping paper 53 and can quickly confirm crushing of the flavor capsule 15.

In addition, the flavor capsule 15 is arranged inside the hollow portion 54, and the flavor capsule 15 is crushed such that the colored content liquid 152 therein diffuses inside the hollow portion 54 and is directly released to the third filter wrap sheet 523, which is the air-permeable paper exposed inside the hollow portion 54, so as to permeate and diffuse in the sheet. For this reason, even if the amount of the colored content liquid is small compared with the case where the flavor capsule 15 described in the first to fourth embodiments is embedded in the filter member, the crushing of the flavor capsule 15 can be confirmed quickly.

In the description of the fifth embodiment, the example of the filter comprising two filter segments and one hollow portion has been described, but the number of filter segments and hollow portions is not limited to this. That is, the filter may be in a form in which n (n is an integer of 3 or more) filter segments are connected via (n-1) hollow portions. In this example, it is preferable that n be 2 to 4 and, more preferably, n be 2 to 3.

Sixth Embodiment

FIG. 10 is an enlarged schematic cross-sectional view showing a part of a filtered smoking article 6 according to the sixth embodiment. The filtered smoking article 6 according to the sixth embodiment has the same configuration as the filtered smoking article 5 according to the fifth embodiment except that configurations of a filter 62 and tipping paper 63 are different from the fifth embodiment.

In the sixth embodiment, the filter 62 further comprises a fourth filter wrap sheet 624 wound around the outer peripheral surface of the third filter wrap sheet 523 which is air-permeable paper. A transparent plug wrapper described in the second embodiment is used as the fourth filter wrap sheet 624.

The tipping paper 63 is wound around the outer peripheral surface of the downstream end part of the cigarette rod 11 and the outer peripheral surface of the filter 62 to connect the cigarette rod 11 and the filter 62. The tipping paper 63 has an opening part 63*a*, and a part other than the opening part 63*a* is an opaque part 63*b*. The tipping paper 63 has the same configuration as the tipping paper 23 described in the second embodiment except that the opening part 63*a* is arranged to be opposed to the flavor capsule 15 arranged inside the hollow portion 54 which is a release region of the colored content liquid.

In the filtered smoking article 6 according to the sixth embodiment, the same advantages as those of the filtered smoking article 5 according to the fifth embodiment can be obtained.

Seventh Embodiment

FIG. 11 is an enlarged schematic cross-sectional view showing a part of a filter smoking article 7 according to the seventh embodiment. The filtered smoking article 7 according to the seventh embodiment has the same configuration as the filtered smoking article 5 according to the fifth embodiment except that configurations of a filter 72 and tipping paper 73 are different from the fifth embodiment.

The filter 72 comprises two filter segments 72*a* and 52*b* arranged with a hollow portion (cavity) 54 sandwiched therebetween. A flavor capsule 75 is arranged in the hollow portion 54 of the filter 72.

The first filter segment 72*a* is composed of a filter member 521*a* and a first filter wrap sheet 722*a* wound around the filter member 521*a*. The air-permeable paper described in the first embodiment is used as the first filter wrap sheet 722*a*. That is, the first filter wrap sheet 722*a* is air-permeable paper, and is arranged to be opposed to a region (filter member 521*a* of the first filter segment 72*a*) where the flavor capsule 75 located in the hollow portion 54 is crushed and colored content liquid 752 therein is released with directivity.

The first filter segment 72*a* and the second filter segment 52*b* arranged with the hollow portion 54 sandwiched therebetween are connected by a third filter wrap sheet 723 which is wound round their outer peripheral surfaces across the hollow portion 54. The third filter wrap sheet 723 may be air-permeable paper, the transparent plug wrapper described in the second embodiment or plain paper. The third filter wrap sheet 723 is preferably air-permeable paper or transparent plug wrapper.

The flavor capsule 75 includes a capsule body 751 and a colored content liquid 752 which is held in the capsule body 751 and contains a flavor component and a colorant. The capsule body 751 has a truncated cone in a horizontal posture, and is arranged in the hollow portion 54 such that a circular surface having a small area faces the first filter segment 72*a*. The flavor capsule 75 having such a shape and such an arrangement posture has a structure having emission directivity when crushed, such that a discharge force is exerted such that the colored content liquid 752 is discharged from the circular surface having a small area toward the first filter segment 72*a* (arrow X in FIG. 11). The colored content liquid 752 has the same configuration as the colored content liquid 152 described in the first embodiment.

The tipping paper 73 is wound around the outer peripheral surface of the downstream end part of the cigarette rod 11 and the outer peripheral surface of the filter 72 to connect the cigarette rod 11 and the filter 72. The tipping paper 73 has a transparent part 73*a*, and a portion other than the transparent part 73*a* is an opaque part 73*b*. The tipping paper 73 has the same configuration as the tipping paper 13 described in the first embodiment except that the transparent part 73*a* is arranged to be opposed to the first filter segment 72*a* which is a release region of the colored content liquid.

In the filtered smoking article 7 according to the seventh embodiment, the same advantages as those of the filtered smoking article 1 according to the first embodiment can be obtained. That is, when the flavor capsule 75 in the hollow portion 54 is crushed, the colored content liquid 752 therein is released toward the filter member 521*a* of the first filter segment 72*a* as represented by the arrow X, depending on the shape and arrangement posture of the flavor capsule 75. The released colored content liquid 752 passes through the filter member 521*a* and permeates and diffuses to the first filter wrap sheet 722*a* which is air-permeable paper. The permeating and diffusing colored content liquid further permeates and diffuses into the third filter wrap sheet 723 which is preferably air-permeable paper and which is wound around the outer surface of the first filter wrap sheet 722*a* to exhibit a clear color. As a result, the smoker can easily visually recognize the third filter wrap sheet 723 and the first filter wrap sheet 722*a*, which are air-permeable papers rapidly exhibiting in a clear color and can quickly confirm crushing of the flavor capsule 75 through the transparent part 73*a* of the tipping paper 73.

Eighth Embodiment

FIG. 12 is an enlarged schematic cross-sectional view showing a part of a filtered smoking article 8 according to the eighth embodiment. The filtered smoking article 8 according to the eighth embodiment has the same configuration as the filtered smoking article 7 according to the seventh embodiment except that the configurations of a filter 82 and tipping paper 83 are different from the seventh embodiment.

In the eighth embodiment, a first filter segment 72*a* and a second filter segment 52*b* arranged with a hollow portion 54 disposed therebetween are connected by a third filter wrap sheet 823 wound around their outer peripheral surfaces across the hollow portion 54, and the transparent plug wrapper described in the second embodiment is used as the third filter wrap sheet 823.

The tipping paper 83 is wound around the outer peripheral surface of the downstream end part of the cigarette rod 11 and the outer peripheral surface of the filter 82 to connect the cigarette rod 11 and the filter 82. The tipping paper 83 has an opening part 83*a*, and a portion other than the opening part 83*a* is an opaque part 83*b*. The tipping paper 83 has the same configuration as tipping paper 23 described in the second embodiment except that the opening part 83*a* is arranged to be opposed to the first filter segment 72*a* which is a release region in which the colored content liquid is released at a position along the longitudinal direction of the filter 82.

In the filtered smoking article 8 according to the eighth embodiment, the same advantages as those of the filtered smoking article 7 according to the seventh embodiment can be obtained.

The embodiment will be described below in more detail by experiment examples.

Test Example 1: Permeability and Opacity of Filter Wrap Sheet

In this test example, test samples 1 to 3 of a filter in which the flavor capsule is arranged are prepared, and influence of the permeability and opacity of the filter wrap sheet is evaluated.

(1) Preparation of Test Sample (1-1) Preparation of Test Sample 1

Acetyl cellulose fibers (5.9Y35000 (trade name) manufactured by Daicel Corporation) formed in a cylindrical shape having a diameter of 7.7 mm and a length of 27 mm was used as the filter member. In the central part of the filter member, a spherical flavor capsule having a diameter of 3.5 mm is embedded. The flavor capsule has a structure in which colored content liquid of 17.1 μl is held in the capsule body having a volume of 22.4 μl. The colored content liquid contains MCT as a solvent, copper chlorophyll as a colorant, menthol as a flavor component, and a thickener, and has a viscosity of 86 mPa·s. A filter wrap sheet (P-10000C, manufactured by Nippon Paper Papylia Co., Ltd.) having an area of 661.5 mm which has an air permeability of 10000 C.U. and an opacity of 39.65% was wound on the outer peripheral surface of the filter member via a normal adhesive (HM335-00 (trade name), manufactured by Henkel Corporation). Transparent cellophane (P-BD #600 (trade name) manufactured by Futamura Chemical Industries Co., Ltd.) was wound via a normal adhesive (HMS1101B (trade name) manufactured by Daidokasei, Co., Ltd.), on the outer peripheral surface of the air-permeable paper.

(1-2) Preparation of Test Samples 2 and 3

Test sample 2 was prepared in the same manner as test sample 1 except that a filter wrap sheet (P-30000C, manufactured by Nippon Paper Papylia Co., Ltd.) having an air permeability of 30,000 C.U. and an opacity of 31.36% was used. Similarly, test sample 3 was prepared in the same manner as test sample 1 except that a filter wrap sheet (plain paper, manufactured by Nippon Paper Papylia Co., Ltd.) having an air permeability of 0 C.U. and an opacity of 67.65% was used.

(2) Test Method

The portion of each of test samples 1 to 3 into which the flavor capsule was embedded was pressed in the diameter direction such that load of 15 N was applied to the flavor capsule, and the flavor capsule was crushed. Next, after placing for 1 minute, the state in which the colored content liquid leaked to the filter wrap sheet was observed and the color intensity ΔE [−] was measured. At this time, the color intensity was measured by SpectroEye which is a measuring device manufactured by X-Rite, Incorporated, in conformity with JIS 8781. Each of the test samples 1 to 3 was tested 4 times, and the average value is shown in Table 1 as the test result of the color intensity ΔE [−]. In addition, states of the colored content liquid leaking on filter wrap sheets of test sample 3 (FL3), test sample 1 (FL1), and test sample 2 (FL2) are schematically shown in (a), (b), and (c) of FIG. 13.

TABLE 1

| | | Air permeability [C.U.] | Opacity [%] | Color intensity ΔE[−] |
|---|---|---|---|---|
| Test sample 1 | P-10000C | 10000 | 39.65 | 17.58 |
| Test sample 2 | P-30000C | 30000 | 31.36 | 14.56 |
| Test sample 3 | Plain paper 24 | 0 | 67.65 | 34.93 |

(3) Test Results

As clarified from the test results shown in (a) to (c) of FIG. 13, it can be understood that in the test samples 1 and 2 having air permeability of 10,000 C.U. and 30,000 C.U., respectively, the area (S1 and S2) where the colored content liquid exuded to the filter wrap sheet is 1.5 times to 2 times wider than the same area (S3) of the test sample 3 having air permeability of 0 C.U. It can be understood from this result that the colored content liquid is likely to spread on the surface of the filter as the air permeability of the filter wrap sheet is higher. According to the test results shown in Table 1, the color intensity ΔE in the test samples 1 and 2 is lower than that in the test sample 3 since the area in which the color content liquid has permeated to the filter wrap sheet is wider, but a sufficient value can be obtained since the opacity is 30% or more.

Test Example 2: Viscosity of Colored Content Liquid of Flavor Capsule

In this test example, test samples 4 to 6 of a filter in which the flavor capsule was arranged were prepared, and influence of the viscosity of the colored content liquid of the flavor capsule was evaluated.

(1) Preparation of Test Sample (1-1) Preparation of Test Samples 4 to 6

Test samples 4, 5 and 6 were prepared in the same manner as the test sample 1 except that the viscosity of the colored content liquid was changed to 86 mPa·s, 118 mPa·s, and 162 mPa·s, respectively, by changing the amount of the thickener added. The viscosity was measured with a rotational viscometer (TVB-10M manufactured by Toki Sangyo Co., Ltd.) with the temperature of the colored content liquid adjusted to 20° C. in conformity with JIS-K7117-1.

(2) Test Method

The portions of test samples 4 to 6 in which the flavor capsules were embedded were pressed in a diameter direction such that load of 15 N was applied to the flavor capsules, and the flavor capsules were crushed. At this time, on the outer peripheral surface of each of the test samples 4 to 6, the colored content liquid permeated into two portions which were the outer peripheral surface portions where the filter was pressed in the diameter direction. Next, after placing for 1 minute, the filter wrap sheet of each test sample was removed, and the distance [mm] between the regions where the colored content liquid exuded to the filter wrap sheet was measured. Each of the test samples was tested 4 times, and the average value is shown in FIG. 14 as the test result.

(3) Test Results

It can be understood from the results of FIG. 14 that as the viscosity of the colored content liquid of the flavor capsule of each test sample is lower, the distance between the regions where the colored content liquid exudes to the filter wrap sheet is shorter. It can be understood from this result that as the viscosity of the colored content liquid of the flavor capsule is lower, the colored content liquid spreads more easily on the surface of the air-permeable paper wound on the outer peripheral surface of the filter member.

Test Example 3: Air Permeability of Paper and Oil Absorbency by Klemm Method

In this test example, measurement of oil absorbency [mm] was measured in conformity with the Klemm method (JIS 8141), which is a water absorbence test method, for each of paper 1 to 7 manufactured by Nippon Paper Papylia Co., Ltd. as shown in Table 2.

(1) Test Method

Each paper 1 to 7 was cut in a width of 15 mm and a length of 200 mm to prepare test pieces. Next, a marked line was drawn with a pencil to 15 mm from a shorter side of each test piece, and a clip serving as a weight was attached between the marked line and the shorter side. A container was filled with medium chain fatty acid triglyceride (MCT) at 23° C., which is a common solvent of a flavor capsule, and the non-marked end of each test piece was attached to a hanger. Subsequently, it was confirmed that the marked line of the test piece was in a horizontal line, and the test piece was rapidly immersed in the MCT to the marked line and placed for 5 minutes. After that, in the test piece, the height [mm] in which the MCT was elevated from the marked line was measured to determine the oil absorbency [mm] by the Klemm method. Each paper was tested 10 times, and the average value is shown in Table 2 as a test result. The time to immerse the test piece in MCT was set to 5 minutes by assuming the average smoking time of the filtered smoking article.

TABLE 2

| | Pager | Air permeability [C.U.] | Opacity [%] | Basis weight [gsm] | Thickness [μm] | Density [g/cm$^3$] | Oil absorbency [mm] |
|---|---|---|---|---|---|---|---|
| Paper 1 | LPWS-OLL | 1300 | 44.21 | 26.5 | 48 | 0.55 | 18.3 |
| Paper 2 | S52-7000 | 7000 | 56.93 | 52.0 | 110 | 0.47 | 30.6 |
| Paper 3 | P10000C | 10000 | 39.65 | 24.0 | 60 | 0.40 | 23.3 |
| Paper 4 | P20000C | 20000 | 37.40 | 26.5 | 75 | 0.35 | 26 |
| Paper 5 | P30000C | 30000 | 31.36 | 21.0 | 77 | 0.27 | 24.3 |
| Paper 6 | Plain paper 24 | 0 | 67.65 | 24.0 | 32 | 0.75 | 13.3 |
| Paper 7 | 50NFB | 0 | 57.36 | 50.0 | 52 | 0.96 | 11 |

(2) Test Results

A high oil absorbency of 18.3 mm to 30.6 mm could be obtained in the test pieces of paper 1 to 5 having the air permeability of 1,000 C.U. to 30,000 C.U., based on the results of Table 2. In addition, a particularly high Klemm oil absorbency of 23.3 mm to 30.6 mm could be obtained with the test pieces of paper 2 to 5 having the air permeability of 7,000 C.U. to 30,000 C.U. It can be understood from this result that, in the paper having a high air permeability, the Klemm oil absorbency of MCT is about 1.5 times to 2 times higher, and MCT spreads over a wider area as compared with the test piece of paper 6 made of plain paper 24. FIG. 15 is a graph showing the relationship between the density of paper and the degree of oil absorbency by the Klemm method. It can also be understood from this result that, in paper having a low density, the Klemm oil absorbency of MCT is high and MCT spreads over a wider area since the air permeability of the paper is generally high.

Test Example 4: Value of Amount of Colored Content Liquid/Cross-Sectional Area of Filter In this test example, test samples 7 to 12 were prepared to evaluate the value of the amount of colored content liquid of the flavor capsule/cross-sectional area of filter.

(1) Preparation of Test Samples 7 to 12

Spherical flavor capsules 1 and 2 having the dimensions shown in Table 3 were prepared. Next, test samples 7 to 12 shown in Table 5 were prepared in the same manner as the test sample 1 except that the flavor capsules 1 and 2 were embedded in filters 1 to 3 having dimensions shown in Table 4. Table 5 shows the values [μl/mm$^2$] of the amount of colored content liquid/cross-sectional area of the filter in the respective test samples at this time.

TABLE 3

| | Flavor capsule 1 | Flavor capsule 2 |
|---|---|---|
| Flavor capsule Diameter [mm] | 3.5 | 3 |
| Flavor capsule Volume [μl] | 22.45 | 14.1 |
| Capsule body [wt. %] | 24 | 24 |
| Amount of colored content liquid [μl] | 17.1 | 10.7 |

TABLE 4

| | Filter 1 | Filter 2 | Filter 3 |
|---|---|---|---|
| Diameter of filter [mm] | 7.67 | 7.00 | 5.35 |
| Cross-sectional area of filter [mm$^2$] | 46.22 | 38.52 | 22.46 |

TABLE 5

| | Flavor capsule | Filter | Amount of colored content liquid/Cross-sectional area of filter [μl/mm$^2$] |
|---|---|---|---|
| Test sample 7 | 1 | 1 | 0.369 |
| Test sample 8 | 1 | 2 | 0.443 |
| Test sample 9 | 1 | 3 | 0.76 |
| Test sample 10 | 2 | 1 | 0.232 |

TABLE 5-continued

| | Flavor capsule | Filter | Amount of colored content liquid/Cross-sectional area of filter [μl/mm$^2$] |
|---|---|---|---|
| Test sample 11 | 2 | 2 | 0.279 |
| Test sample 12 | 2 | 3 | 0.478 |

(2) Test Method

The portions of test samples 7 to 12 in which the flavor capsules were embedded were pressed in a diameter direction such that load of 15 N was applied to the flavor capsules, and the flavor capsules were crushed. At this time, on the outer peripheral surface of each of the test samples 7 to 12, the colored content liquid permeated into two portions which were the outer peripheral surface portions where the filter was pressed in the diameter direction.

(3) Test Results

It can be understood from the results that when the values [μl/mm$^2$] of amount of colored content liquid/cross-sectional area of the filter in the respective test samples are 0.2 μl/mm$^2$ or more, the colored content liquid spreads sufficiently on the surface of the air-permeable paper wound on the outer peripheral surface of the filter member.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A filtered smoking article comprising:

a smoking body;

a filter comprising a filter member arranged at a downstream end of the smoking body and an air-permeable paper provided to be wound around an outside of the filter member, and further having a flavor capsule arranged therein; and a tipping paper wound around an outer peripheral surface of a downstream end part of the smoking body and an outer peripheral surface of the filter, and connecting the smoking body and the filter, wherein the flavor capsule comprises a capsule body, and a colored content liquid stored in the capsule body and containing a flavor component, wherein the air-permeable paper is arranged to be opposed to a region in which the colored content liquid is released when the flavor capsule is crushed, and has an air permeability of 1,000 C.U. to 30,000 C.U. a density of 0.27-0.55 g/cm$^3$ and an opacity of 40% or more and 70% or less, and wherein the tipping paper is impermeable to the colored content liquid, and comprises at least three transparent parts that are arranged to be spaced apart from each other in the circumferential direction of the tipping paper and each of the transparent parts is arranged to be opposed to the region in which the colored content liquid is released so as to include parts facing the flavor capsule.

2. The filtered smoking article of claim 1, wherein each of the transparent parts of the tipping paper is arranged such that an angular interval of the adjacent transparent parts is set at 150° or less as viewed from a central point in a cross section perpendicular to the longitudinal direction of the filter.

3. The filtered smoking article of claim 1, wherein the tipping paper includes a cellophane, a polyolefin film, a polyvinyl chloride film, or a cellulose acetate film.

4. The filtered smoking article of claim 1, wherein each of the transparent parts of the tipping paper has a larger length along a longitudinal direction of the filter as compared with a length along the circumferential direction of the tipping paper.

5. A filtered smoking article, comprising:

a smoking body;

a filter comprising a filter member arranged at a downstream end of the smoking body, an air-permeable paper provided to be wound around an outside of the filter member, and a transparent plug wrapper provided to be wound around an outside of the air-permeable paper, and further having a flavor capsule arranged therein; and a tipping paper wound around an outer peripheral surface of a downstream end part of the smoking body and an outer peripheral surface of the filter, and connecting the smoking body and the filter, wherein the flavor capsule comprises a capsule body, and a colored content liquid stored in the capsule body and containing a flavor component, wherein the air-permeable paper is arranged to be opposed to a region in which the colored content liquid is released when the flavor capsule is crushed, and has an air permeability of 1,000 C.U. to 30,000 C.U. and a density of 0.27-0.55 g/cm$^3$ and an opacity of 40% or more and 70% or less, wherein the transparent plug wrapper is impermeable to the colored content liquid and has a transparent part at least in part, and wherein the tipping paper comprises at least three opening parts that are arranged to be spaced apart from each other in the circumferential direction of the tipping paper, and each of the opening parts is arranged to be opposed to the region in which the colored content liquid is released.

6. The filtered smoking article of claim 5, wherein each of the opening parts of the tipping paper is arranged such that an angular interval of the adjacent opening parts is set at 150° or less as viewed from a central point in a cross section perpendicular to the longitudinal direction of the filter.

7. The filtered smoking article of claim 5, wherein the transparent plug wrapper includes a cellophane, a polyolefin film, a polyvinyl chloride film, or a cellulose acetate film.

8. The filtered smoking article of claim 5, wherein each of the opening parts of the tipping paper has a larger length along a longitudinal direction of the filter as compared with a length along the circumferential direction of the tipping paper.

9. The filtered smoking article of claim 1, wherein the colored content liquid has a viscosity of 120 mPa·s or less.

10. The filtered smoking article of claim 1, wherein the colored content liquid contains the flavor component and a colorant.

11. The filtered smoking article of claim 1, wherein the air-permeable paper has an opacity of 30% or more.

12. The filtered smoking article of claim 1, wherein a value of an amount of the colored content liquid/cross-sectional area of the filter is 0.2 □l/mm2 or more.

13. The filtered smoking article of claim 1, wherein the filter member comprises a plurality of filter members arranged to be spaced apart from each other with a hollow portion sandwiched therebetween, wherein the flavor capsule is arranged in the hollow portion, and wherein the air-permeable paper is provided to be wound around outsides of the plurality of filter members across the hollow portion.

14. The filtered smoking article of claim 1, wherein the filter member comprises a plurality of filter members arranged to be spaced apart from each other with a hollow portion sandwiched therebetween, wherein the flavor capsule is arranged in the hollow portion, wherein the flavor capsule releases the colored content liquid to one of the filter members arranged with the hollow portion sandwiched therebetween when pressed, and wherein the air-permeable paper is provided to be wound around an outside of one of the filter members to which the colored content liquid is released.

15. The filtered smoking article of claim 1, wherein the filter material surrounds the flavor capsule so that the filter material is between the at least three transparent parts and the flavor capsule.

16. The filtered smoking article of claim 5, wherein the filter material surrounds the flavor capsule so that the filter material is between the at least three opening parts and the flavor capsule.

17. A filtered smoking article comprising:

a smoking body;

a filter comprising a filter member arranged at a downstream end of the smoking body and an air-permeable paper provided to be wound around an outside of the filter member, and having a flavor capsule arranged therein; and a tipping paper wound around an outer peripheral surface of a downstream end part of the smoking body and an outer peripheral surface of the filter, and connecting the smoking body and the filter, wherein the flavor capsule comprises a capsule body, and a colored content liquid stored in the capsule body and containing a flavor component, wherein the air-permeable paper is arranged to be opposed to a region in which the colored content liquid is released when the flavor capsule is crushed, and has an air permeability of 1,000 C.U. to 30,000 C.U., and wherein the tipping paper is impermeable to the colored content liquid, and comprises an opaque part and at least three transparent parts that are arranged to be spaced apart from each other in the circumferential direction of the tipping paper, wherein each of the transparent parts is arranged to be opposed to the region in which the colored content liquid is released so as to include parts facing the flavor capsule, and wherein an opaque ink is printed inside the opaque part.

18. A filtered smoking article, comprising:

a smoking body;

a filter comprising a filter member arranged at a downstream end of the smoking body, an air-permeable paper provided to be wound around an outside of the filter member, and a transparent plug wrapper provided to be wound around an outside of the air-permeable paper, and further having a flavor capsule arranged therein; and a tipping paper wound around an outer peripheral surface of a downstream end part of the smoking body and an outer peripheral surface of the filter, and connecting the smoking body and the filter, wherein the flavor capsule comprises a capsule body, and a colored content liquid stored in the capsule body and containing a flavor component, wherein the air-permeable paper is arranged to be opposed to a region in which the colored content liquid is released when the flavor capsule is crushed, and has an air permeability of 1,000 C.U. to 30,000 C.U., wherein the transparent plug wrapper is impermeable to the colored content liquid and has a transparent part at least in part, and wherein the tipping paper comprises an opaque part and at least three opening parts that are arranged to be spaced apart from each other in a circumferential direction of the tipping paper, wherein each of the opening parts is arranged to be opposed to the region in which the colored content liquid is released, and wherein an opaque ink is printed inside the opaque part.

* * * * *